US005145439A

United States Patent [19]

Wagener

[11] Patent Number: 5,145,439

[45] Date of Patent: Sep. 8, 1992

[54] FUSELAGE OF A MODEL AIRPLANE INJECTION MOLDED FROM PLASTIC AND HAVE WINDOWS

[75] Inventor: Claus W. Wagener, Dietenhofen, Fed. Rep. of Germany

[73] Assignee: Herpa Miniaturmodelle GmbH, Dietenhofen, Fed. Rep. of Germany

[21] Appl. No.: 734,524

[22] Filed: Jul. 23, 1991

[30] Foreign Application Priority Data

Jul. 27, 1990 [DE] Fed. Rep. of Germany ..... 4023888

[51] Int. Cl.[5] ..... A63H 27/00; A63H 33/22; F21V 7/04

[52] U.S. Cl. ..... 446/34; 446/219; 362/32

[58] Field of Search ..... 446/7, 34, 219, 85, 446/87, 88, 93, 94, 95, 96, 230, 231, 438, 439, 485; 362/31, 32

[56] References Cited

U.S. PATENT DOCUMENTS

| | | | |
|---|---|---|---|
| 2,754,620 | 7/1956 | Gilbert et al. | 446/85 |
| 2,883,796 | 4/1959 | Reveka | 446/219 |
| 2,886,911 | 5/1959 | Hardesty | 362/31 X |
| 3,126,667 | 3/1964 | Rabinow | 446/94 |
| 3,693,281 | 9/1972 | Wolf | 446/88 |
| 4,559,022 | 12/1985 | Herstein et al. | 446/219 X |
| 4,891,030 | 1/1990 | Gertzfeld | 446/485 X |
| 5,040,320 | 8/1991 | Reidinger | 362/32 X |

FOREIGN PATENT DOCUMENTS

| | | | |
|---|---|---|---|
| 3737519 | 5/1989 | Fed. Rep. of Germany | 446/93 |
| 3737520 | 5/1989 | Fed. Rep. of Germany | 446/93 |
| 3744775 | 5/1989 | Fed. Rep. of Germany | 446/93 |

*Primary Examiner*—Mickey Yu
*Assistant Examiner*—D. Neal Muir
*Attorney, Agent, or Firm*—Akoo-Toren

[57] ABSTRACT

The invention discloses a fuselage which is subdivided into a fuselage lower part (1) and a shell-shaped upper fuselage portion (3) where the upper fuselage portion (3) is provided with windows arranged in rows (12, 13), the windows being formed by inserted pieces (8) with the fuselage moulded around them, the windows being formed on an integral insert part (7). It is desirable that, on the one hand, the upper fuselage portion including the injection-moulded window pieces be of simpler construction and, on the other hand, should have a continuous external fuselage surface extending continuously without any conspicuous joint line down to the joint with the fuselage lower part. This is accomplished in that the upper fuselage portion (7) is of single-piece construction down to the joint (2) to the fuselage lower part (1) with the windows being surrounded by said upper fuselage portion, and in that the elongated insert part (7) of shell-shaped construction continuously lines the upper fuselage portion piece (3) on the inside. The simplified single piece construction of the upper fuselage portion provided with windows is achieved by the use of the insert part which is conveniently made by injection moulding.

8 Claims, 2 Drawing Sheets

FUSELAGE OF A MODEL AIRPLANE INJECTION MOLDED FROM PLASTIC AND HAVE WINDOWS

DESCRIPTION

Figure 1:
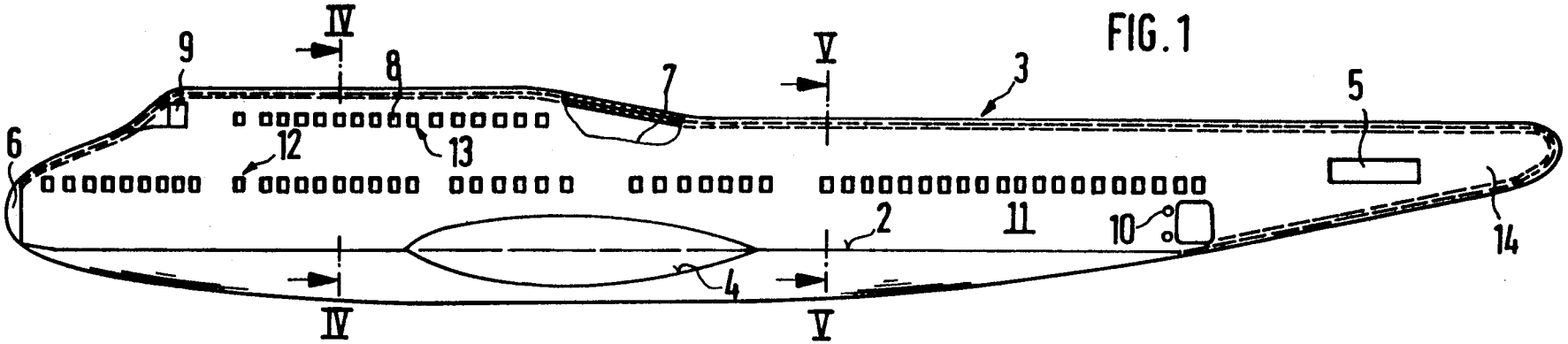

This invention relates to a fuselage of a model airplane consisting of plastic which fuselage is horizontally divided along a longitudinally extending joint into a fuselage lower part and a shell-shaped upper fuselage portion where the upper fuselage portion is provided on both sides with windows arranged in rows which windows are flush with the external surface of the fuselage and where the windows are formed by inserted pieces of transparent plastic around which is moulded the fuselage and the window pieces are integral with an elongated insert part.

In a prior-art (DE-OS 37 37 518) fuselage of this kind, the upper fuselage portion is composed of a shell-shaped fuselage upper part and an intermediate plate on which the windows are provided. The insert part of the intermediate plate is of flat configuration and embedded in an enclosing frame. This construction is of advantage where on the external surface of the fuselage the intermediate plate has a different colour, except for the windows, from that of fuselage upper part. However, where the upper fuselage portion has a uniform colour on the external fuselage surface down to the joint, then this construction is complex and involves a conspicuous joint-line between the fuselage upper part and the intermediate plate.

It is an object of the present invention to provide a fuselage of the type initially referred to whose upper fuselage portion, including the window pieces around which the fuselage is moulded is, on the one hand, of simpler construction and, on the other hand, has an external fuselage surface which extends free from a conspicuous joint-line continuously down to where it is joined to the fuselage lower part. In achieving this object, the fuselage according to the invention is characterized in that the upper fuselage portion, which is moulded around the windows is of single-piece construction down to where it is joined to the fuselage lower part, and in that the elongated insert part is of shell-shaped construction and continuously lines the inside of the upper fuselage portion piece.

The simplified single-piece construction of the upper fuselage portion piece, which is provided with windows, is accomplished by the use of a conveniently injection-moulded insert part. This shell-shaped insert part can be injection-moulded on a core and, subsequently, the single-piece upper fuselage portion can be injection-moulded on the insert part while it continues to be on the same core. In spite of the windows, the upper fuselage portion can be constructed with an external fuselage surface that is of a single colour and free from a joint-line. The framing of the windows is formed by an outer shell and the windows are formed by an inner shell consisting of a transparent plastic.

The cross-section of the window pieces may, for instance, be constant, as seen from their free end, down to the shell-shaped insert part. However, it is specially desirable and advantageous to have the cross-section of the window pieces, as seen from their free end, increase towards the shell-shaped insert part. Even where the window pieces form only relatively small windows, the window pieces thanks to their splayed root will readily withstand the combination of flow, pressure and heat as the single-piece upper fuselage portion is injection-moulded onto the insert part.

Furthermore, it is also desirable and advantageous to have a rear end fuselage part tapering in its cross-section towards the tail end and to have the upper fuselage portion piece and the shell-shaped insert part closed all round in the region of the tapering tail end. In other words, the shells formed by the upper fuselage portion and the inset part would be closed at the bottom in the region of the fuselage tail piece. This construction is suitable where the outer surface of the tapering fuselage tail end is desired to have the same colour as the other external surface of the upper fuselage portion.

Moreover, it is specially desirable and advantageous to have the wall thickness of the shell-shaped insert part appreciable smaller than the wall thickness of the shell-shaped fuselage portion. The shell-shaped insert part, i.e. the "lining" would be kept as thin as compatible with injection moulding technique because it really only serves as a support of the window pieces. For example, the insert part may be 1.4 mm thick and the upper fuselage portion piece 2.4 mm thick. The upper fuselage portion would be of substantially the same thickness throughout its full length.

Moreover, it is specially desirable and advantageous to have the shell-shaped insert part extend from one end to the other end of the upper fuselage portion piece and to have its cross-section taper towards both ends. In other words, the shell-shaped insert part would also be provided where no windows exist which is an advantage from the point of injection moulding technique.

In addition, it specially desirable and advantageous to have a piece of the shell-shaped insert part extending through the upper fuselage portion piece form a pilot window at the front of the fuselage and/or a loading hatch lamp at the rear of the fuselage. In other words, the shell-shaped insert part may be used to facilitate the forming of further features of the fuselage.

It is specially desirable and advantageous (to apply the invention) where two rows of windows are provided on the sides of the fuselage. The fact that the shell-shaped insert part lines the upper fuselage portion over its full cross-section will facilitate the provision of a second row of window pieces.

Figure 5:
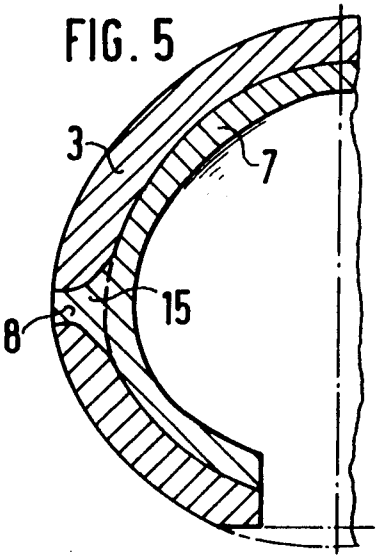
Figure 4:
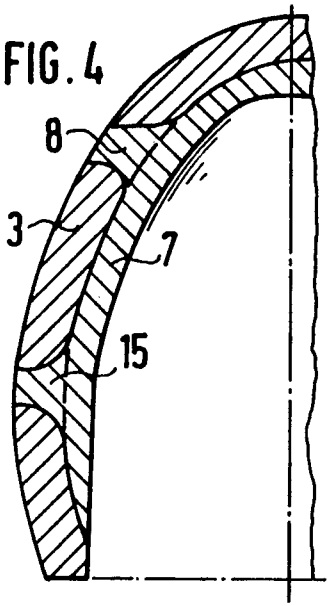
Figure 2:
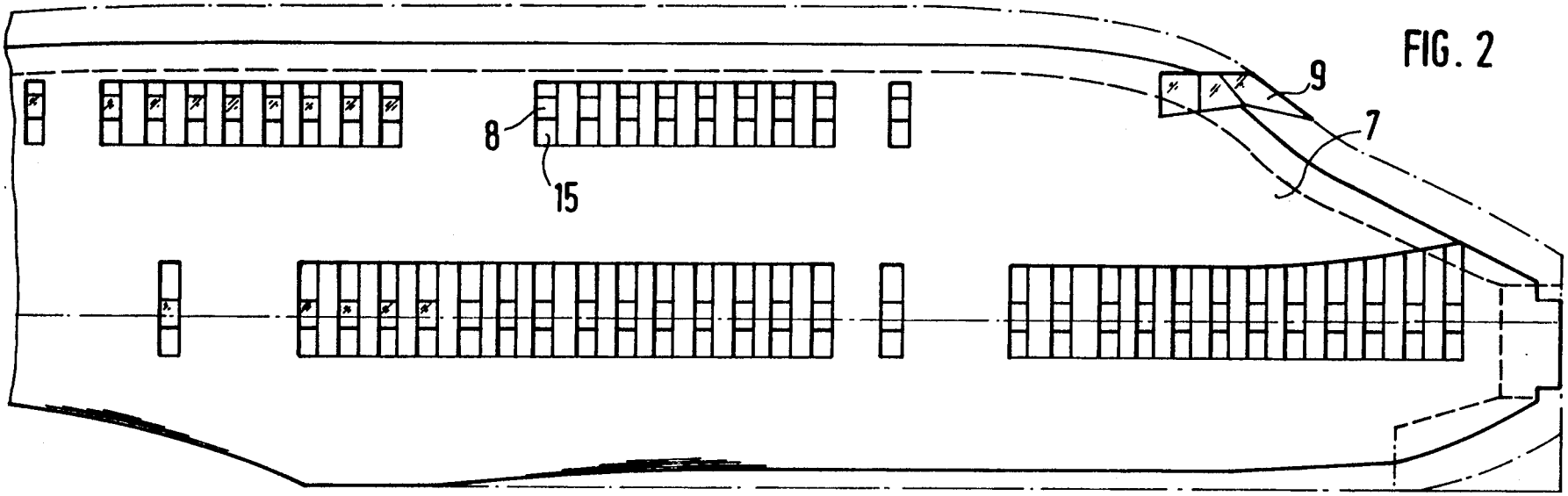
Figure 3:
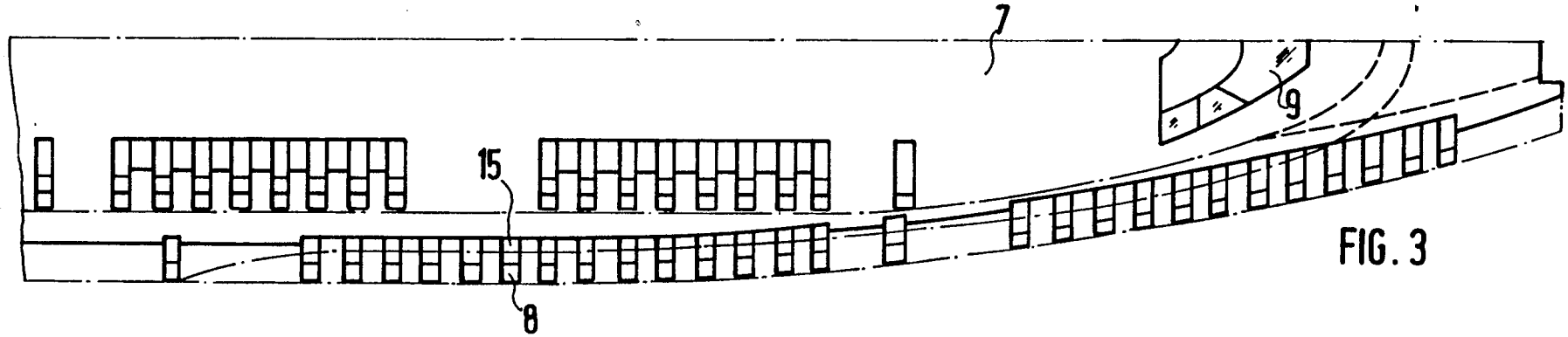

A preferred embodiment of the invention is illustrated in the accompanying drawing in which FIG. 1 is a side elevation of a fuselage of a model airplane, FIG. 2 is a side elevation of the front section of the insert part of the fuselage shown in FIG. 1, but on an enlarged scale compared to FIG. 1, FIG. 3 is a plan-view of one half of the section shown in FIG. 2, FIG. 4 is a section along the line IV—IV in FIG. 1, but on an enlarged scale compared to FIG. 1 and FIG. 5 is a section along the line V—V in FIG. 1, but on an enlarged scale compared to FIG. 1.

The fuselage shown in the drawing is produced from plastic by injection moulding and has a fuselage lower part 1 which engages an upper fuselage portion piece 3 along a longitudinally extending joint 2, the bottom edge of said upper fuselage portion piece extending as shown, but the joint line may have any alternative shape. Between said upper fuselage portion piece 3 and the fuselage lower part 1 there is a cut-out 4 into which are inserted the wings (not shown). In the upper fuselage portion piece 3 there is a cut-out 5 into which is inserted the horizontal tail surface (not shown). At the front end of the fuselage portion piece 3 there is a fuselage nose 6. Inside the upper fuselage portion piece 3 there is provided a shell-shaped insert part 7 made of transparent plastic which insert part is formed on its outside with window pieces 8, a pilot window piece 9 and loading hatch lamp pieces 10 each of which penetrates through the upper fuselage portion piece 3 to terminate flush with the external surface 11 of the fuselage. There is a lower row 12 and an upper row 13 of windows on each side of the fuselage.

The insert part 7 is elongated or oblong and extends over the full length of the upper fuselage portion piece 3, its cross-section decreasing towards both ends. The insert part 7 is of shell-shaped construction and open at the bottom over the greater part of its length, as can be seen in FIGS. 4 and 5. Where the tail-end piece 14 is of a pointed shape, however, the upper fuselage portion piece 3 and the insert part 7 may be closed at the bottom, i.e. the tail piece would be a hollow pointed structure. The window pieces 8 are splayed on two opposite sides to form a kind of reinforcing root 15 with which the individual window-piece blend into the insert part 7. The window pieces 8, their splayed roots 15 as well as the pilot window piece 9 are illustrated in FIGS. 2 and 3.

Generally, the upper fuselage portion piece 3 and the elongated insert part 7 would of the same kind of plastic, specifically, of a modified polystyrene ABS (acryonitrile butadienestyrene copolymerisat). In this case, too, the upper fuselage portion piece can be injection-moulded on the already cooled-down elongated insert pat without causing any damage to the latter and its window pieces.

I claim:

1. A fuselage of a model airplane, the fuselage consisting of plastic and comprising a fuselage external surface which is horizontally subdivided along a longitudinally extended butt joint into a fuselage lower part and a shell-shaped upper fuselage portion, the upper fuselage portion being provided on opposing sides with windows arranged in rows, which windows are flush with the external surface of the fuselage, an elongated shell-shaped injection-molded insert part comprises the inside of the upper fuselage portion, and provides in transparent plastic window units that serve as the windows of the upper fuselage portion, the windows are located at opposing sides of the upper fuselage portion and are framed by the upper fuselage portion, the upper fuselage portion being injection molded as a single piece onto the shell-shaped insert part comprising the window units down to the butt joint with the fuselage lower part.

2. A fuselage as in claim 1, wherein the window units have a cross-section, seen from their free end, that increases towards the shell-shaped insert part.

3. A fuselage as in claim 1, wherein the cross-section of the fuselage tail end tapers towards a rear end of the fuselage, characterized in that in the region of the tapering tail end piece the upper fuselage portion and the shell-shaped insert part are closed all around.

4. A fuselage as in claim 1, wherein the wall thickness of the shell-shaped insert part is appreciably smaller than the wall thickness of the shell-shaped fuselage portion.

5. A fuselage as in claim 1, wherein the shell-shaped insert part extends from one end to the other end of the upper fuselage portion and its cross-section decreases towards both ends.

6. A fuselage as in claim 1, wherein a piece of the shell-shaped insert part penetrating through the upper fuselage portion forms one of a pilot window at the front of the fuselage and a cargo hatch lamp in the rear of the fuselage.

7. A fuselage as in claim 1, wherein two rows of windows above each other are provided on a side of the fuselage.

8. A fuselage as in claim 1, wherein the upper fuselage portion and the elongated insert part consist of the same type of plastic and specifically of a modified polystyrene ABS.

* * * * *